United States Patent [19]

Delgado et al.

[11] 4,421,312

[45] Dec. 20, 1983

[54] FOLDABLE BOARD GAME WITH CARD SHUFFLER

[76] Inventors: Pedro R. Delgado, % George Spector, George Spector, % Pedro R. Delgado, both of 3615 Woolworth Bldg, 233 Broadway, New York, N.Y. 10007

[21] Appl. No.: 371,319

[22] Filed: Apr. 23, 1982

[51] Int. Cl.[3] ..... A63F 3/00

[52] U.S. Cl. ..... 273/236; 273/149 R; 273/285; 273/287

[58] Field of Search ..... 273/149 R, 236, 285, 273/287, 266, 268

[56] References Cited

U.S. PATENT DOCUMENTS

| | | | |
|---|---|---|---|
| 449,316 | 3/1891 | Falkingham | 273/149 R |
| 557,205 | 3/1896 | Hinckley | 273/236 X |
| 1,434,034 | 10/1922 | Aegerter el al. | 273/149 R |

FOREIGN PATENT DOCUMENTS

| | | | |
|---|---|---|---|
| 252902 | 3/1912 | Fed. Rep. of Germany | 273/149 R |

OTHER PUBLICATIONS

"Put and Take", *Scarne's Encyclopedia of Games,* pp. 321–322, ©1973.

*Primary Examiner*—Richard C. Pinkham
*Assistant Examiner*—Scott Brown

[57] ABSTRACT

A board game for being played competitively between up to four players, and including a gameboard divided into nine areas, a set of chips for each player to place upon the gameboard areas, and a deck of cards carrying instructions for placements and removals of the chips. The game board being foldable to enclose a card shuffling device.

3 Claims, 6 Drawing Figures

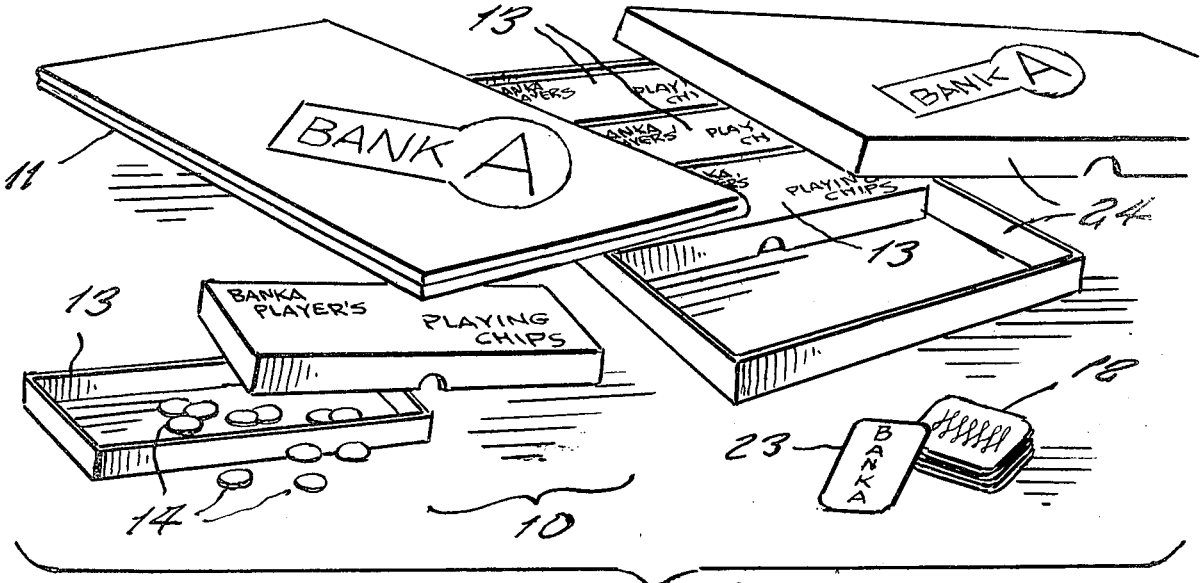
Fig. 1
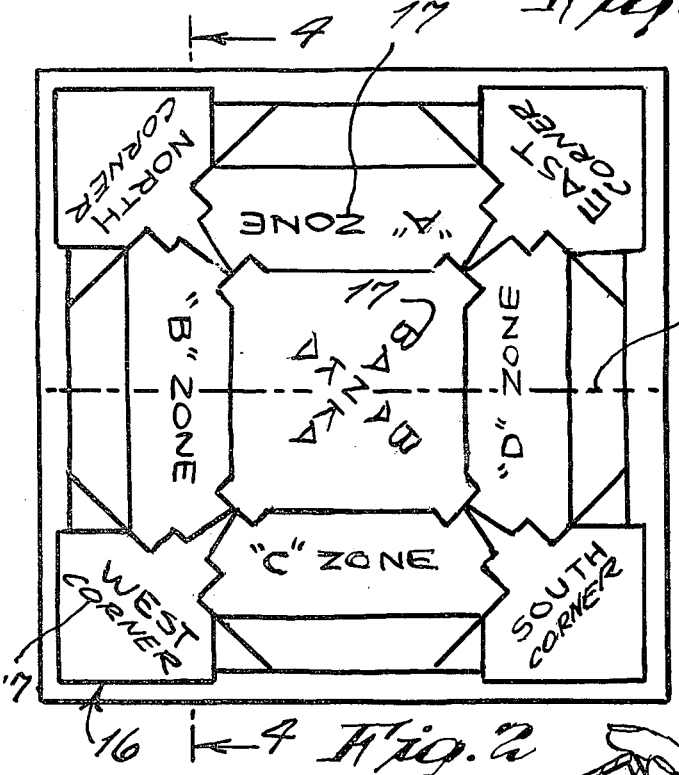
Fig. 2
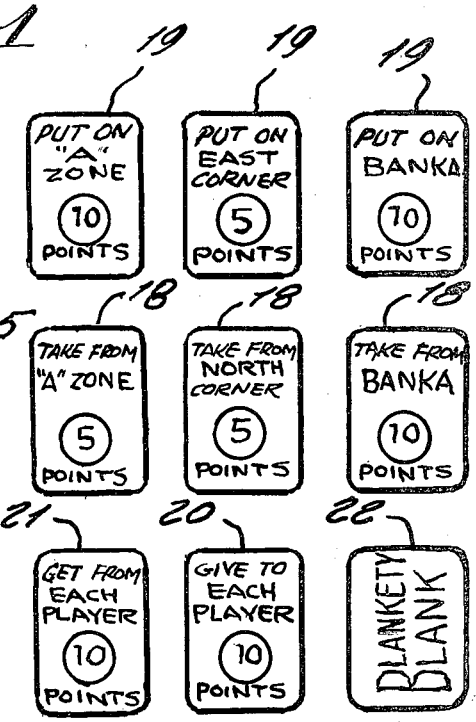
Fig. 3
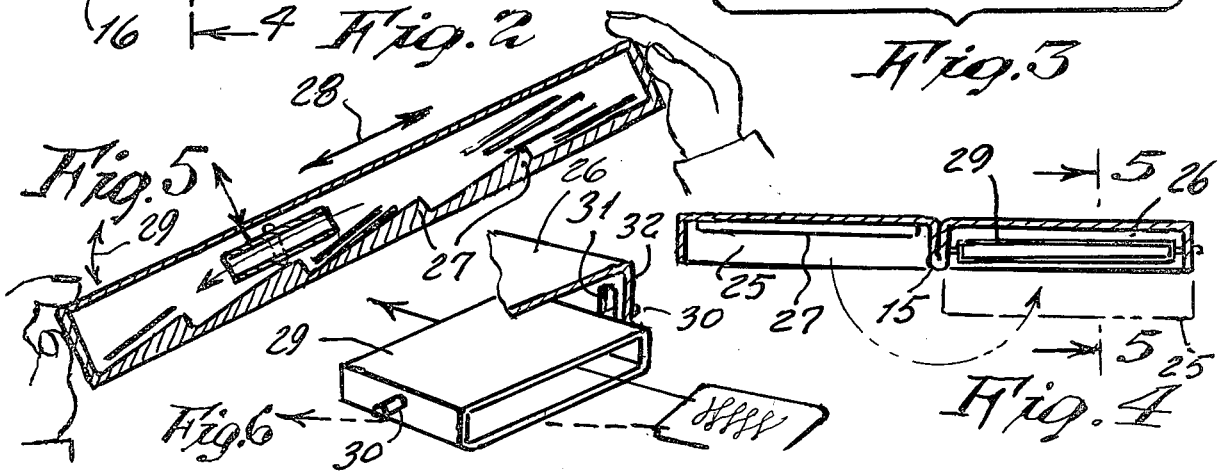
Fig. 5
Fig. 6
Fig. 4

FOLDABLE BOARD GAME WITH CARD SHUFFLER

This invention relates generally to board games.

A principal object of the present invention is to provide a new type of board game in which playing cards, used therewith, carry playing instructions such as taking, putting, getting or giving a certain amount of the chips to or from the various areas of the gameboard.

Yet another object is to provide a game in which a single one of the cards drawn from the deck by a player, ends the game, and the drawer collects all the chips left on the boards.

Yet another object is to provide a game in which the playing cards thereof are shuffled in a hollow box as to obtain a thorough shuffle especially by younger children or other players who are not particularly skilled to do so in a conventional manner.

FIG. 1 is a perspective view of the invention components.

FIG. 2 is a plan view of the gameboard opened up.

FIG. 3 is a view of different groups of the cards.

FIG. 4 is a cross sectional view on line 4—4 of FIG. 3 and shown including card shuffling structure inside the gameboard.

FIG. 5 is a cross sectional view on line 5—5 of FIG. 4, and showing a vertically movable tube for some cards to clear by chance a stop shoulder of one of the riffles.

FIG. 6 is a perspective view of the vertically movable tube of FIG. 5.

Referring now to the drawing in greater detail, the reference numeral 10 represents a BANKA game according to the present invention, wherein there is a foldable gameboard 11, a deck of 12 forty five special playing cards, and four boxes 13 of playing chips 14.

The gameboard is square shaped, foldable about a central fold line 15 and has a playing field 16 imprinted on one side consisting of nine spaces or pockets, as shown in FIG. 2, and each of which is identified by a text 17, such as west corner, "A" zone, Banka, and the like.

The fourty five playing cards are comprised of the following:

Eighteen "take from" cards 18.

Eighteen "put on" cards 19.

Two "give to each player" cards 20.

Two "get from each player" cards 21.

Four "Blankety Blank" cards 22.

One "Banka" card 23.

As shown in FIG. 3, it is to be noted that all the "take from" cards are not a same in text, and all the "put on" cards are not a same in text.

All the components of the game can be fitted in a box 24 so to be retailed as a complete game device.

In playing the game, the cards are first shuffled and players then in turn pick up a top card from the upside down deck as shown in FIG. 1. Each player at his turn follows the card instructions each player, at the start of the game, is given one of the boxes 13, each box containing a same number of the chips, each chip representing a point in the game. In following the card instructions, he either takes chips from his box and places them on the board where so instructed, or gives them to the other players, or receives chips from the gameboard or from the other players.

The game is thus continued until one of the players draws the Banka card 23 which ends the game, the player drawing the Banka card taking all the chips that are on the gameboard at that time. The players then each add up the number of chips (or points) they have so to determine who has most and is declared the winner.

The "Banka" game may be provided with its own means to shuffle the cards by having the gameboard 11*a* being made in the form of a boxlike case 25 and boxlike cover 26 hinged together along the fold line 15, the playing field 16 being imprinted on the outer sides of the case and cover so to be played upon when opened up as shown in FIG. 4, and which, when closed, serves to shuffle the cards therewithin, as shown in FIG. 5.

A series of riffles 27 are formed inside one of the boxlike members, so that when the cards are placed inside the closed case and cover, and the same is then shaken in a sliding manner as indicated by arrow 28 and intermitantly or at same time occassionally is also shaken upwardly as indicated by arrow 29, the sliding cards fall behind the various riffles so to regroup themselves in various different arrangements. Thus a thorough shuffle is attained.

As shown in FIGS. 4, 5 and 6, a tubular bridge 29 may be included above one or each of the riffles 27 so to allow a shuffling card to travel across the riffle and not become lodged behind the riffle. The bridge is a cross sectionally rectangular tube so to accommodate the passage of cards therethrough. A shaft 30 formed on opposite sides of the tube extends outwardly by being slidable in slots 31 formed in opposite side walls 32 of the cover 26, so that the shafts may be manually manipulated by a person in order to raise or lower the bridge, as preferred, in order to control either more or less of the shuffling cards as they travel in a riffle vicinity. Thus a still more thorough shuffling can be obtained.

While various changes may be made in the detail construction, it is understood that such changes will be within the spirit and scope of the present invention as is defined by the appended claims.

What is claimed:

1. A new Banka game, comprising in combination, a gameboard, a deck of playing cards having playing instructions printed thereupon, and a plurality of chips, said playing instructions informing where said chips are placed upon or removed from said gameboard or to and from other players of said game, said gameboard including a fold line across a center thereof, a playing area imprinted on one side of said gameboard and being divided into spaces, said gameboard additionally comprising a boxlike case and cover which are pivotally joined along said fold line to form a box when closed together so to form an enclosure therebetween for shuffling said cards therewithin, said boxlike case having a series of riffles inside said enclosure, and behind which said cards settle in a re-aligned arrangement when said box is closed, and means for selective said cards only becoming settled behind said riffles.

2. The combination as set forth in claim 1, wherein said means comprises a tubular bridge briding at least one said riffle, a shaft affixed to opposite sides of said tube protruding outwardly of said enclosure of or manual adjustment of said bridge to be close or far above said riffle.

3. The combination as set forth in claim 2, wherein said gameboard playing area has four corner zones of identical shape and symetrical location, a central zone contacting each said corner zone, and an intermediate zone between each said corner zone.

* * * * *